United States Patent [19]

Maidanik et al.

[11] Patent Number: 4,515,209

[45] Date of Patent: May 7, 1985

[54] HEAT TRANSFER APPARATUS

[75] Inventors: Jury F. Maidanik; Sergei V. Vershinin, both of Sverdlovsk; Valery F. Kholodov, Zhukovsky; Jury E. Dolgirev, Sverdlovsk, all of U.S.S.R.

[73] Assignee: Otdel Fiziko-Tekhnicheskikh Problem Energetiki Uralskogo Nauchnogo Tsentra Akademi Nauk SSR, U.S.S.R.

[21] Appl. No.: 596,444

[22] Filed: Apr. 3, 1984

[51] Int. Cl.[3] ..... F28D 15/00

[52] U.S. Cl. ..... 165/104.22; 165/104.26; 417/208

[58] Field of Search ..... 165/104.22, 104.26; 417/208

[56] References Cited

U.S. PATENT DOCUMENTS 4,467,861 8/1984 Kiseev et al. ..... 165/104.22

FOREIGN PATENT DOCUMENTS 691672 10/1979 U.S.S.R. ..... 165/104.22

846980 7/1981 U.S.S.R. ..... 165/104.22

*Primary Examiner*—Albert W. Davis, Jr.

*Attorney, Agent, or Firm*—Steinberg & Raskin

[57] ABSTRACT

A heat transfer apparatus comprises an evaporating chamber having arranged in the interior thereof essentially coaxially therewith a vaporizer fabricated from capillary material permeable to a heat transfer fluid and adapted to maintain a thermal contact with a heat source, and a condenser chamber. The vaporizer is provided with vapor release passages communicable with a vapor header, and a longitudinal axial passage communicable with each of two end cavities. Each of the end cavities is defined by the end surface of the vaporizer and the walls of the chamber. A zone of the condenser chamber containing the heat transfer fluid in a vapor phase communicates with the vapor header of the vaporizer by way of a first pipe, while the zone thereof containing the heat transfer fluid in a liquid phase communicates by way of a second pipe with the evaporating chamber. The vapor release passages are defined by longitudinal recesses and a multiplicity of annular recesses intersecting with the longitudinal recesses, the recesses being arranged on the outer surface of the vaporizer between annular projections thereof and intended to prevent vapor passing from the vapor release passages to the end cavities.

11 Claims, 7 Drawing Figures

HEAT TRANSFER APPARATUS

FIELD OF THE INVENTION

This invention relates to heat engineering, and more particularly to heat transfer devices.

The invention can find application in cooling systems associated with radioelectronic and other equipment installed in units which in the course of operation change their orientation in mass force fields including a gravitational field, or are subject to inertial forces varying in magnitude and direction.

BACKGROUND OF THE INVENTION

There are known highly efficient heat transfer devices or heat pipes featuring a conglomeration of very useful characteristics such as a rather low thermal resistance enabling to transfer high density heat fluxes at a small temperature differential between a heat source and a heat sink, low weight per unit heat transferred, high reliability due to absence of moving parts, moderate overall dimensions and the capability of being employed in a wide range of temperatures. In addition, heat pipes can be made in a broad variety of shapes and sizes for special heat transfer situations.

Structurally, the conventional heat pipe is very simple. It is normally a pressure-tight vessel fabricated as a rule from metal, the atmospheric air being removed from the interior of the vessel. The inner surface of such a vessel is lined with a capillary material wet by a liquid which functions as a heat transfer fluid.

Operation of the heat pipe is based on the well known laws of physics. When heat is applied from a heat source to one end of the heat pipe, the heat transfer fluid is caused to evaporate from the capillary material to absorb the latent heat of vaporization, whereby vapor is moved toward the other (cooled) end of the heat pipe to condense therein for the heat of condensation to be transferred to an outer heat sink through heat conduction. The thus condensed heat transfer fluid is absorbed by the capillary material to be moved back by virtue of a capillary pressure head toward the evaporation zone thereby completing the working cycle of the heat pipe. High efficiency of the heat pipe as a "heat conductor" is therefore determined by that liquids feature rather high heat of vaporization which enables to remove from the evaporation zone considerable heat fluxes at a relatively low consumption of the heat transfer fluid, as well as by that heat is transferred mainly by vapor which is moved along a pipe without the need for a high pressure differential since the hydraulic diameter of the vapor passages is, as a rule, sufficiently great.

A principle equation associated with heat pipe operation is based on the balance of pressures and may be expressed as:

$$\Delta Pc \geqq \Delta Pb + \Delta Pv + \Delta Pg \quad (1),$$

where $\Delta Pc$ is the capillary pressure head, in $N/m^2$;

$\Delta Pb$ is the pressure differential in the liquid moving in the capillary material, in $N/m^2$;

$\Delta Pv$ is the pressure differential, of the vapor in the vapor passage, in $N/m^2$; and $\Delta Pg$ is the hydrostatic head determined by the mutual interposition of the evaporation and condensation zones of the heat pipe in a mass force field, in $N/m^2$.

In its simplest form the capillary pressure head for capillary pores of generally cylindrical form may be expressed by the Laplace equation:

$$\Delta Pc = \frac{2\sigma}{r_c} \operatorname{Cos}\theta, \quad (2)$$

where $\sigma$ is the surface tension coefficient, in N/m;

$\theta$ is the value of the extreme angle at which the inner wall of the capillary pore is wet by the liquid, in deg.

This equation is true if the curvature radius of the vapor-liquid interface in the vapor condensation zone tends to be infinite, which corresponds to a flat interface, or if the wetting angle in the condensation zone is 90°.

When capillary pores are of complex configuration the capillary pore radius is substituted by a notion of effective radius which can be found experimentally.

Pressure differential in a laminar flow of incompressible viscous liquid moving through a cylindrical capillary pore having a radius of $r_c$ may be described by the Hagen-Poiseuille formula:

$$\Delta P1 = \frac{G8\eta_e\zeta}{\pi r_c 4\rho e}, \quad (3)$$

where

G is the mass consumption of liquid, in kg/cm;

$\eta e$ is the dynamic viscosity factor, in $N \cdot s/m^2$; and $\zeta$ is the effective length of the heat pipe, in m; and $\rho e$ is density of the liquid, in $kg/m^3$.

The movement of vapor in the heat pipe is governed by more complex laws and may vary in the evaporation zone, condensation zone and the transport (adiabatic) pipe portion. Therefore, the complete pressure differential in the vapor phase $\Delta Pv$ is generally the total of pressure differentials at the above three portions of the heat pipe. Because a detailed analysis of the component pressure losses in the vapor phase is outside the scope of the present invention, it is suffice to cite a publication entitled "Heat Pipes" by P. D. Dunn and D. A. Reay, Pergamon Press, Oxford, New York, Toronto, Sydney, Paris, Braunscheweig, 1976, where such an analysis is contained in pages 35 to 49.

The last term of the equation (1) determined by the hydrostatic head of the liquid is determined through:

$$\Delta Pg = \rho l \cdot g \cdot \zeta \cdot \operatorname{Sin}\phi \quad (4),$$

where $\rho l$ is the density of the heat transfer fluid in a liquid phase, in $kg/m^3$;

g is the acceleration of gravity, in $m/s^2$; and $\phi$ is the angle between the longitudinal centerline of the heat pipe and the horizontal, in deg.

Depending on the mutual position of the evaporation and condensation zones in the field of mass forces, the term $\Delta Pg$ of the equation (1) enters this equation either with a positive sign (+) or with a negative sign (−). When the evaporation zone is above the condensation zone, the angle of inclination of the heat pipe is considered positive, while $\operatorname{Sin}\phi > 0$ and $\Delta Pg$ has a positive sign (+) imparting a hydrostatic resistance. In consequence, an increase in the length of the heat pipe and in the angle of inclination thereif result in an increased hydrostatic pressure attaining its maximum value at $\phi=90°$. The hydrostatic pressure $\Delta Pg$ contributes to a great extent to the total of pressure losses. Therefore, it must be taken into account even at negligeable inclination angles of the heat pipe, as well as at horizontal positioning of heat pipes of larger diameter. Especially susceptible to variation in the positive inclination angle in the field of mass forces are low-temperature heat pipes wherein use is made of heat transfer fluids having a relatively low surface tension factor. In this case, it is advisable to employ capillary materials having small radius of capillary pores in order to attain sufficiently high values of the capillary pressure head $\Delta Pc$. However, according to the expression (3), the growth in the hydraulic resistance is directly proportional to the square of the pore radius. This results in that the distance over which heat is transferred and the amount of heat flux are limited to such an extent that their advisability is questionable when rated operating conditions include situations where the heat pipe may be oriented such that the liquid phase of the heat transfer fluid must move against a gravity head or other mass forces.

There is known a heat pipe construction described in U.S. Pat. No. 3,666,005. This heat pipe is made up of a plurality of interconnected serial sections, each of the sections being actually an independent heat pipe. The inner surface of the sections is lined with capillary material saturated with a heat transfer fluid. The sections are so interconnected that an end face wall confining the condensation zone of a serially preceding section is integral with an end face wall confining the evaporation zone of every succeeding section, and so forth.

Therefore, the arrangement is such that the condensation zone of every preceding section is in thermal contact with the evaporation zone of the succeeding section of this heat pipe assembly. Because the heat transfer fluid is calculated independently in each of the sections and the length of each such section is relatively small, it stands to reason that within each of the sections the distance over which the liquid heat transfer fluid has to travel through the capillary material is rather short, which makes it possible to use capillaries with sufficiently large radius to enable to transfer markedly larger heat fluxes with the heat transfer fluid travelling against a gravity head as compared to conventional heat pipes.

However, this known heat pipe has a high thermal resistance caused by that heat transfer between the sections is effected by virtue of heat conduction through the separating walls possessing a certain amount of resistance to heat. Apparently, in order to increase the overall length of such a heat pipe, it is necessary to employ larger number of sections. In consequence, this leads to a greater number of walls separating the sections the total heat resistance of which makes up the overall thermal resistance of the heat pipe. It can be easily assumed that the thermal resistance of a heat pipe made up of a plurality of such sections will be higher than the thermal resistance of conventional heat pipes whereby the basic advantage of a heat transfer apparatus of this type, such as low thermal resistance, will be lost. Therefore, at a given temperature difference between a heat source and a heat sink the heat flux capacity of the abovedescribed heat pipe will be lower than that of conventional heat pipes.

Attempts to increase the heat flow transferred through reducing its hydraulic resistance resulted in a heat transfer apparatus protected by U.S. Pat. No. 3,741,289. This heat transfer apparatus is fashioned as a closed conduit defining an essentially circular heat link comprising at one portion thereof a vaporizer of capillary material saturated with a heat transfer fluid in thermal contact with a source of heat. A portion of the conduit remote from the vaporizer is adapted to maintain thermal contact with the heat sink. A portion of the conduit adjacent the vaporizer is provided with a liquid header. One part of the conduit disposed between the heat source and the heat sink serves to transmit the heat transfer fluid in a vapor phase, while the other part thereof is intended to carry the heat transfer fluid in a liquid phase. The apparatus is capable of providing a contact of the heat transfer fluid in a liquid phase with the vaporizer under no heat load. To this end, there is provided a reservoir arranged away from the heat link and communicating with the apparatus by way of a passage. The reservoir has a flexible diaphragm separating the heat transfer fluid from another heat transfer fluid partially in a liquid and partially in a vapor state the vapor pressure of which fluid exerted on the vaporizer under zero heat load is higher than the vapor pressure of the first heat transfer fluid and, conversely, it is lower when the temperature of vapor of the heat transfer fluid is raised subsequent to the application of a heat load. Therefore, in the absence of heat load the diaphragm assumes a curved or arched position toward one side of the reservoir for the heat transfer fluid to be driven from the reservoir to come into thermal contact with the vaporizer. When the pressure and temperature of vapor released by the heat transfer fluid subsequent to the application of the heat load have been increased, the heat transfer fluid is driven from the vapor portion of the conduit into the liquid portion thereof to come into contact with the outer surface of the vaporizer through the liquid header. Excess heat transfer fluid is forced into the reservoir to cause the diaphragm to assume a position curved toward the other side of the reservoir.

High heat flux capability of this apparatus is assured by that the distance travelled by the heat transfer fluid in the capillary material toward the evaporation surface is relatively small. Therefore, pressure losses in this apparatus are much less than in conventional heat pipes, which in turn enables to reduce the effective radius of the capillary pores and thereby increase the capillary head providing a motive force for the heat transfer fluid.

However, inherent in the above heat transfer apparatus is, in the first place, a disadvantage residing in a relatively small surface area intended for carrying the heat transfer fluid toward the vaporizer occupying a narrow annular portion of its outer surface. Extending the length of the vaporizer surface to convey a heat load thereto may cause insufficient feeding of remote portions of the vaporizer due to capillary resistance and, as a result, to essentially the same limitations in the travel of the heat transfer fluid against the action or mass forces as in conventional heat pipes. A second disadvantage resides in the overall bulk of the apparatus due to the liquid header and the separate reservoir arranged outside the heat link. Thirdly, the apparatus may have insufficient reliability because the movable element thereof, i.e. the diaphragm, is susceptible to residual deformations and mechanical wear.

A further reduction in the hydraulic resistance at a portion of the travel path of the heat transfer fluid in a vapor phase through the capillary material has been attained in a construction of a heat transfer apparatus according to USSR Inventor's Certificate No. 691,672.

This known apparatus comprises evaporating and condenser chambers communicable through conduits, the first of the conduits being intended to convey the heat transfer fluid in a vapor phase, the second conduit serving to carry the heat transfer fluid in a liquid phase. Accommodated in the interior of the evaporating chamber coaxially therewith is a vaporizer of capillary material saturated with the heat transfer fluid and adapted to maintain a thermal contact with a heat source. The vaporizer consists of two portions end surfaces of which are tightly adjacent therebetween. Each portion of the vaporizer is provided with longitudinal and radial vapor release passages communicable with a vapor header incorporated into the vaporizer and having the form of an annular recess occupying a border area between the two portions of the vaporizer. The vaporizer further has a longitudinal axial passageway communicable with each of two end cavities defined by the end surfaces of the vaporizer and the walls of the evaporating chamber. Provided in the side wall of the evaporating chamber is an inlet port for a first pipe to communicate with the vapor header, whereas an end face wall facing the condenser chamber has an outlet port for a second pipe to communicate with the end cavity of the evaporation chamber, this outlet port of the second pipe being arranged either in said cavity or in the longitudinal axial passageway of the vaporizer.

The condenser chamber is generally a shell in the form of a cup the bottom of which faces the evaporation chamber. Installed inside the cup coaxilly therewith is another shell to form between the side and end surface of the first shell facing the evaporating chamber and respective surfaces of the second shell an annular space and a planoparallel space located at a right angle relative to the first space, the two spaces defining the interior of the condenser chamber. The end face wall of the first shell facing the evaporating chamber has an outlet port for the first pipe communicable with the interior of the condenser chamber, an inlet port for the second pipe being arranged in the side wall of the first shell to communicate with the interior of the condenser chamber and spaced from the first port lengthwise of the chamber.

The heat transfer apparatus is charged with a heat transfer fluid in the amount sufficient to saturate the vaporizer, fill the second pipe, a portion of the condenser chamber, the longitudinal axial passageway, one end cavity and partially the other end cavity.

During operation of the apparatus under heavy operating condition when it is oriented in the field of mass forces essentially vertically for the evaporation chamber thereof to overly the condenser chamber, substantial inconveniencies may arise due to occurence of a hydrostatic resistance $\Delta Pg$ tending to reach its maximum value. In the absence of heat load the vaporizer is saturated with the heat transfer fluid, while the balance of the heat transfer fluid occupies a certain level in the pipes as in communicating vessels. When a heat load is applied to the vaporizer, the heat transfer fluid is caused to evaporate from the surface of the vapor release passages, the surface of the longitudinal axial passage and from the end surfaces of the vaporizer. However, thanks to the thermal resistance of the layer of capillary material saturated with the heat transfer fluid which separate said surfaces, a temperature difference and, consequently, a pressure difference occur in the region above these surfaces.

This pressure difference may be determined according to the Clausius-Clapeyron equation as follows:

$$\Delta P = \frac{LP_1\Delta T}{RT_1^2}, \tag{5}$$

where

L is the latent heat of vaporization, in J/kg;

$P_1$ is the pressure of vapor above the evaporation surface of the vapor release passages, in $N/m^2$;

$T_1$ is the temperature of vapor in the vapor release passages, in K;

$\Delta T$ is the vapor temperature difference between the evaporation surfaces, in K; and R is the universal gas constant, in J/K·kg.

Under the action of this pressure difference the heat transfer fluid in a liquid phase is caused to be driven out from the first pipe of the condenser chamber to occupy the end cavities and the longitudinal axial passageway of the vaporizer wherefrom it moves essentially in a radial direction through the vaporizer to be conveyed in the evaporation surface of the vapor release passages.

In consequence, two levels of the liquid heat transfer fluid are established in the apparatus, particularly one in the upper end cavity at a temperature of $T_2$ of vapour thereabove, and the other one in the condenser chamber at a temperature of $T_3$ of vapor above this level. Therewith, it is necessary that a condition $T_3 > T_2$ and $P_3 > P_2$ be compiled with. This condition is fulfilled because a cooled heat transfer fluid is admitted to the evaporating chamber, the saturated vaporizer maintaining its function of a "thermal gate". It should be noted here that the temperature $T_3$ is somewhat lower than the temperature $T_1$ due to losses caused by the travel of vapor along the first pipe and the annular space of the condenser chamber, whereas the condition $P_3 > P_2$ is realized in case the capillary pressure head in the vaporizer meets the following condition:

$$\Delta Pc \geqq P_3 - P_2 + \Delta Pl + \alpha Pv \tag{6}$$

It is therefore evident that the pressure difference $P_3 - P_2$ is approximately equal in value to the hydrostatic pressure $\Delta Pg$ which is exerted by a column of the liquid heat transfer fluid confined between free surfaces in the evaporation and condenser chambers.

Accordingly, since the distance travelled by the liquid heat transfer fluid in the capillary material is relatively short and not dependent on the length of both the heat transfer apparatus and the vaporizer per se due to the predominantly radial path of travel thereof, it becomes possible to employ capillary pores very small in radius. This affords to obtain a high capillary pressure head even when a heat transfer fluid with a relatively low surface tension factor is used. In addition, the aforedescribed apparatus is reliable and moderate in size because the end cavities function as a reservoir for the excess heat transfer fluid, while the moving parts are absent. The level of the heat transfer fluid is controlled by the heat transfer fluid itself through variations in the values of $P_2$ and $P_3$.

Among disadvantages inherent in the abovedescribed heat transfer apparatus are, firstly, the complicated arrangement of the system of vapor release passages which must be great in number to provide a sufficiently large evaporation surface, as well as the inconveniences in terms of providing a reliable and tight connection and accommodation of the two parts of the capillary vaporizer in the housing. Secondly, the insufficient evaporation surface of the vaporizer defined by the side surfaces of the radial vapor release passages which, as has been noted, cannot be numerous enough for purely technological considerations. This hampers vapor release to result in pressure losses therein. Thirdly, another disadvantage is the location of the outlet port of the second pipe in the evaporating chamber at below the level of the liquid heat transfer fluid in the upper end cavity when the apparatus is oriented at angle of inclination $\phi>0°$, which fails to allow the admission of the "cold" heat transfer fluid directly to the upper end cavity through the longitudinal axial passageway having a cross-section by far larger than the cross-section of the second pipe due to the deceleration in the travel velocity of the heat transfer fluid, as well as because of a direct thermal contact thereof with the walls of the longitudinal axial passageway, which result in an increase in the temperature of the heat transfer fluid. In consequence, the temperature $T_2$ and the pressure $P_2$ tend to grow in value leading to a corresponding increase in the values $T_1$, $T_3$ and $P_1$, $P_3$ and, accordingly, to increased temperature of the heat source wherefrom the heat transfer apparatus draws away heat. Fourthly, the provision of the narrow annular space in the condenser chamber having a hydraulic resistance tending to increase further due to a film of condensate flowing downwards and impaired convection when heat is transferred from the outer surface of the condenser chamber to the outside are also disadvantageous because they tend to reduce the highest heat flux capacity transferred by the abovedescribed apparatus.

SUMMARY OF THE INVENTION

It is an object of this invention to increase the heat flux capability of a heat transfer apparatus through increasing the density of heat flux conveyed from a heat source to a vaporizer, reducing the hydraulic resistance of a condenser chamber and improving conditions for carrying heat away from the outer surface thereof.

Another object is to improve the operating reliability of the heat transfer apparatus when it is subjected to vibratory loads and make the apparatus easier to assemble through providing a flexible mechanical linkage between the evaporating and condenser chambers.

These and other objects and advantages are attained by that in a heat transfer apparatus comprising an evaporating chamber having arranged in the interior thereof essentially coaxially therewith a vaporizer of capillary material saturated with a heat transfer fluid and adapted to maintain a thermal contact with a heat source, the vaporizer being vapor release passages communicable with a vapor header and a longitudinal axial passage communicable with each of two end cavities defined by end surfaces of the vaporizer and walls of the evaporating chamber, and a condenser chamber a zone of which containing the heat transfer fluid in a vapor phase communicates with the vapor header of the vaporizer by way of a first pipe, a zone thereof containing the heat transfer fluid in a liquid phase communicating by way of a second pipe with the evaporating chamber, according to the invention, the outer surface of the vaporizer at the ends thereof is provided with smooth annular projections to prevent the flow of vapor from the vapor release passages into the end cavities, the vapor release passages being defined by longitudinal recesses an a plurality of annular recesses intersecting with the longitudinal recesses, the recesses being disposed between the annular projections, the condenser chamber being fashioned as a shell having arranged in the interior thereof substantially coaxially therewith a second shell so as to form between the wall of the first shell and the wall of the second shell a space isolated from the outside, this space tending to reduce or converge in the direction of the vapor travel path therealong, an inlet port of the second pipe being communicable with this space at the portion thereof having the smallest cross-section, an outlet port of the second pipe being located in the end cavity of the evaporating chamber furtherst from the condenser chamber, this second pipe passing inside the longitudinal axial passage of the vaporizer.

This structural arrangement of the heat transfer apparatus enables, in the first place, to substantially increase the evaporation surface of the capillary vaporizer through increasing the total surface area of the vapor release passages. This increases in the surface area provides better conditions for carrying vapor away from this surface resulting in a substantial reduction in the losses of vapor pressure, less thermal resistance in the evaporation zone to finally lead to increased thermodynamic efficiency of the heat transfer apparatus expressed both in greater overall distance over which heat is transferred and in higher heat flux density.

An apparent advantage of such a system of vapor release passages as its structural simplicity and ease of manufacture, since fabrication of a large number of the annular recesses at the outer surface of the vaporizer which mainly constitute the evaporation surface holds no difficulties. By far more complicated is making the longitudinal passages designed to carry vapor to the vapor header. However, these are few in number and their depth may be greater than that of the annular recesses. In addition, the system may be easily differentiated in terms of the length of the vapozer to attain optimum conditions for vapor release.

The system of vapor release passages is disposed between the smooth annular projections arranged adjacent the ends of the vaporizer to serve as sealing elements preventing the flow of "hot" vapor into the end cavities.

The arrangement of the outlet port of the second pipe in the end cavity furtherst from the condenser chamber affords during orientations of the apparatus at inclination angles of $\phi>0°$ to convey the heat transfer fluid condenser and cooled in the condenser chamber directly to the vapor-liquid interface which at these orientations is contained in this chamber, thereby enabling to attain a maximum possible reduction of the temperature $T_2$ and pressure $P_2$ in the region overlying the interface in these conditions. Accordingly, reduction in the temperature $T_2$ and pressure $P_2$ is facilitated by that the heat transfer fluid travels along the portion of the second pipe passing inside the longitudinal axial passage of the vaporizer at a substantially greater velocity failing to be heated prior to entering the end cavity. The reduction in the pressure $P_2$ of vapor while maintaining the necessary pressure differential $P_1-P_2$ makes it possible to appropriately reduce the pressure $P_1$ and temperature $T_4$ of vapor in the vapor release passages. Therefore, start up and operation of the heat transfer apparatus is effected at a much lower temperature level to enable a substantially isothermal operation of the apparatus while maintaining its heat flux capacity accompanied by a more efficient cooling of the heat source.

The arrangement of the condenser chamber according to the principles of this invention makes it possible firstly, to maintain a practically uniform heat transfer efficiency from the whole area of the chamber; secondly, to improve the layout of the heat transfer apparatus, that is to accommodate part of the second pipe in the interior of the second shell; and thirdly, the varying cross-sectional area of the space between the shells lengthwise of the chamber enables to optimize its hydraulic resistance and without substantially increasing the value of this resistance to attain a localized capillary effect in the region of the inlet port of the second pipe required to stabilize a liquid bubble of substantial height which acts to prevent the passage of vapor into the pipe when the apparatus is oriented at inclination angle $\phi \leqq 0°$.

Preferably, the recesses arranged on the outer surface of the vaporizer are triangular in section, apexes of the triangulars facing the longitudinal centerline of the apparatus.

The vaporizer always features a certain temperature gradient in the radial direction and an increase in the depth of recesses for the purpose of reducing their hydraulic resistance causes a temperature difference in the direction toward the tops of the recesses. This may entail, firstly, partial condensation of vapor at the "cold" bottom of these recesses and the formation of a localized "parasitic" circulation of the heat transfer fluid in the zone of evaporation and, secondly, an increase in the heating of the vaporizer in the radial direction toward the longitudinal centerline which results in an increase of vapor temperature in the longitudinal axial passage and the end cavities and, as a consequence, in worsened operating conditions of the heat transfer apparatus. The provision of the recesses of essentially triangular configuration with minimized surface area at their tops enables to reduce the effect of such undesirable situations.

Preferably, the inlet port of the second pipe is arranged at a location lengthwise of the condenser chamber furtherst from the outlet port of the first pipe.

This arrangement allows to more fully utilize the total surface area of the condenser chamber to condense vapor and cool the heat transfer fluid in a liquid phase providing for a substantially isothermal operation of the apparatus.

In order to facilitate the assembly of the apparatus, it is advisable that the first and second pipes have portions in the form of corrugations which would provide a flexible mechanical linkage between the evaporating and condenser chambers.

When vibration loads are imparted to the heat transfer apparatus, it is preferable that the first and second pipes be provided with portions in the form of tubular spirals.

This would enable to provide a flexible mechanical linkage between the evaporating and condenser chambers to bring down mechanical stresses exerted on the pipe connections which may result in a loss of hermiticity of the apparatus.

Advantageously, the heat transfer apparatus is provided with a shell element secured to end face walls of the evaporating chamber and disposed in the longitudinal axial passage of the vaporizer to form a radial space required to convey the heat transfer fluid toward the vaporizer in a radial direction, an interior passage of the shell being communicable with the outside.

This construction of the evaporation chamber affords a more efficient heat insulation of the flow of the liquid heat transfer fluid passing along the second pipe to the end cavity. It has been attained by that the portion of the pipe accommodated in the longitudinal axial passage and in the end cavity filled with the liquid heat transfer fluid is additionally insulated from heat by a separating wall and a layer of the outside medium, such as air, which is known to be a sufficiently good heat insulator. In consequence, the more reliable heat insulation of the pipe affords to convey the liquid heat transfer fluid to the end cavity at almost the same temperature as that it has at the outlet from the condenser chamber. As has been stated heretofore, this makes it possible to further reduce the temperature $T_2$ and pressure $P_2$ of vapor in the end cavity over the vapor-liquid interface to thereby reduce the working temperature of the heat transfer apparatus and the thermal resistance thereof, or, other conditions being equal, to increase the heat flux density and capacity.

Other objects and attendant advantages of this invention will be more fully understood from a subsequent preferred embodiment thereof taken in conjunction with the accompanying drawings.

DETAILED DESCRIPTION OF THE INVENTION

Figure 1:
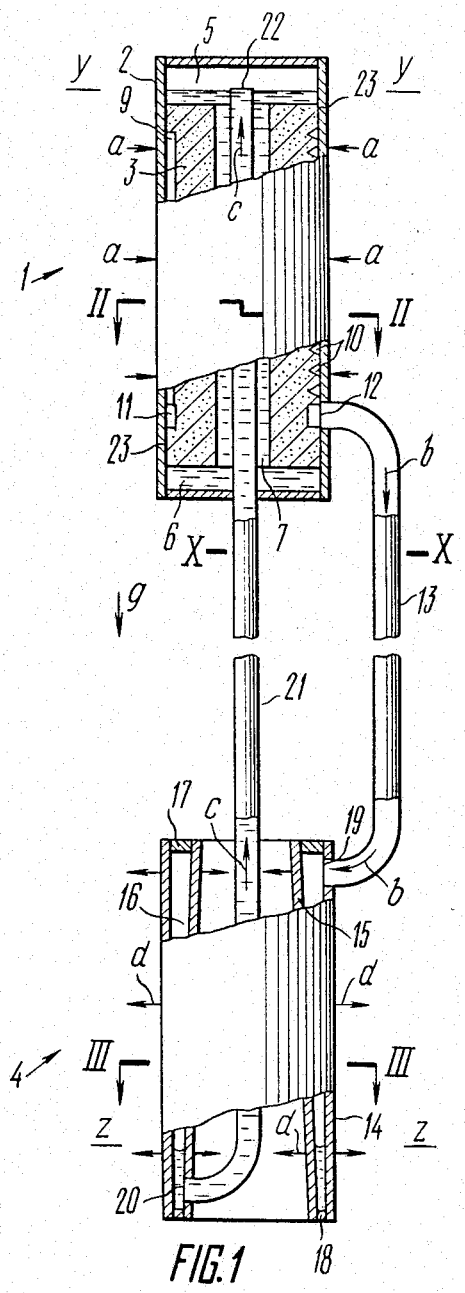
FIG. 1 is a schematic partially cut away view of a heat transfer apparatus embodying the present invention.

A heat transfer apparatus according to the invention comprises an evaporating chamber 1 (FIG. 1) a housing 2 of which has arranged in the interior coaxially therewith a vaporizer 3 of capillary material, such as a metal-ceramic material, adapted to have a thermal contact with a heat source, a heat flux thereof having a path of travel generally indicated by the arrows "a", and a condenser chamber 4. The evaporating chamber 1 is provided with two end cavities 5 and 6 defined by walls of the evaporating chamber 1 and end surfaces of the vaporizer 3. An axial passage 7 is arranged lengthwise of the vaporizer 3 intended in conjunction with the end cavities 5 and 6 to collect and supply a heat transfer fluid toward an evaporation surface (FIG. 2) formed by side walls of vapor release passages having the form of longitudinal recesses 9 and annular recesses 10 on the side surface of the vaporizer 3. The longitudinal and annular recesses 9 and 10 (FIG. 1) are of triangular configuration having apexes thereof adapted to face the longitudinal centerline of the vaporizer 3. The longitudinal vapor release passages 9 are communicable with a vapor header 11 provided on the outer surface of the vaporizer 3 and having the form of an annular recess communicable with an inlet port 12 of a first pipe 13 intended to transmit the heat transfer fluid in a vapor phase toward the condenser chamber 4, the flow path of such vapor being indicated in FIG. 1 by the arrows "b".

Figure 3:
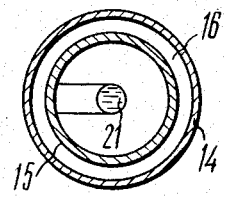
FIG. 3 is a section taken along the line II—II of FIG. 1.
Figure 4:
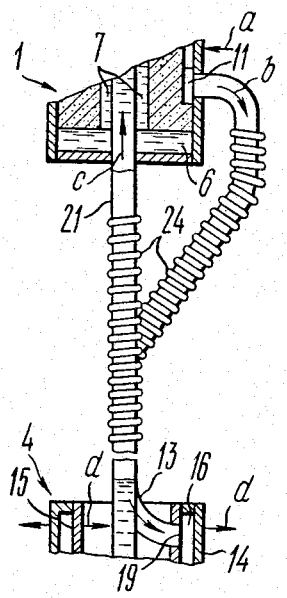
FIG. 4 is a partially sectional view of first and second pipes having portions thereof in the form of corrugations.

The condenser chamber 4 is fashioned as a shell 14 (FIG. 3) having secured in the interior thereof essentially coaxially therewith another shell 15 to form between the wall of the shell 14 and the wall of the second shell 15 a space 16 isolated from the outside by annular cap elements 17 and 18 (FIG. 1), the cross-sectional area of the space 16 reducing or converging in the direction of the vapor travel path along this space. An outlet port 19 of the first pipe 13 is positioned adjacent the evaporating chamber 1 in the side wall of the first shell 14 or, alternatively, it may be arranged adjacent the second shell 15 as seen best in FIG. 4. The two forms of arrangement of the outlet port 19 are equally efficient in terms of thermodynamics, and use can be made of either of the two to suit the situation. An outlet port 20 (FIG. 1) of a second pipe 21 serving to convey the heat transfer fluid in a liquid phase the travel path of which is indicated by the arrows "c" is spaced a maximum possible distance from the outlet port 19 lengthwise of the condenser chamber 4. This second outlet port 20 may be arranged either in the wall of the first shell (not shown) or in the wall of the second shell 15 as deems convenient. The outlet port 20 communicates with the space 16 at a portion thereof having minimal cross-sectional area. Heat may be conveyed away from the condenser chamber 4 in an equally efficient manner either from the surface of the first shell 14 or from the surface of the second shell 15. The flow path of heat toward a heat sink, such as ambient air, is indicated generally by the arrows "d".

An outlet port 22 of the second pipe 21 is arranged in the end cavity 5 furtherst from the condenser chamber 4. The second pipe 21 is adapted to pass through the longitudinal axial passage 7 of the vaporizer 3. In order to prevent the flow of "hot" vapor into the end cavities 5 and 6, the outer surface of the vaporizer 3 is provided with smooth annular projections 23 functioning as sealing elements by adjoining tightly to the inner surface of the housing 2 of the evaporating chamber 1.

For ease of assembly of the heat transfer apparatus according to the invention the first and second pipes 13 and 21, respectively, have corrugated portions 24 (FIG. 4) providing a flexible mechanical linkage between the evaporating chamber 1 and the condenser chamber 4.

Figure 5:
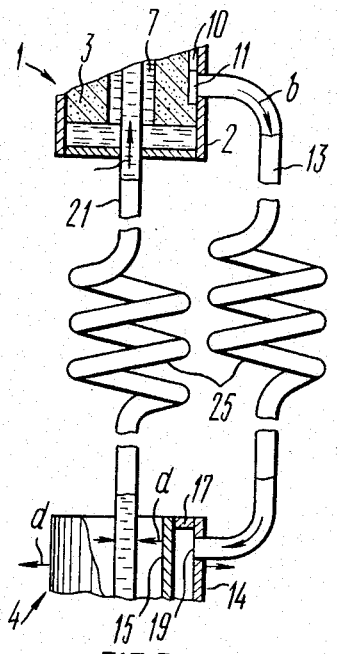
FIG. 5 is a partially cut away view of the first and second pipes having portions thereof fashioned as tubular spirals.

Further, to assure a more reliable operation of the heat transfer apparatus under vibration loads, the pipes 13 and 21 have tubular spiral portions 25 (FIG. 5) providing for a resilient mechanical linkage between the evaporating chamber 1 and the condenser chamber 4.

The heat transfer apparatus according to the invention operates as follows.

In the absence of a temperature load and with the heat transfer apparatus fixed at an inclination angle of $\phi=90°$ in a field of mass forces characterized by a vector "g" (FIG. 1) the level of heat transfer fluid assumes a position x-x in the first and second pipes 13 and 21 filling completely the lower part of the apparatus, the vaporizer 3 being fully saturated with the heat transfer fluid.

The amount of heat transfer fluid required for charging the apparatus and consequently the location of the level x-x is determined by the volume of the heat transfer fluid permeable into the vaporizer 3, the geometrical configuration of the apparatus, the slope of saturation curve of the heat transfer fluid determined by the derivative dP/dT and a number of other factors. For example, if the value of heat load is below a minimum one required for a start up of the apparatus, the vaporizer 3 tends to dry out which is accompanied by a simultaneously increase in the level x-x of the heat transfer fluid due to condensation.

At these conditions the initial position of the level x-x must be such that at the moment the vaporizer 3 loses not more than 40–50% of the heat transfer fluid its level x-x would rise to the outlet port 12 of the first pipe 13. Subsequently, a further drying out of the vaporizer 3 is compensated for by the heat transfer fluid entering through the port 22.

The initial level x-x of the heat transfer fluid may be lower if the vaporizer 3 is saturated prior to start up, for example, by varying the angle $\phi$ by 180°. However, consideration must be given to the fact that during the start up of the heat transfer apparatus even at rated heat loads with the vaporizer 3 completely saturated, it takes time for the heat transfer fluid to come into contact therewith, this time normally amounting to several seconds. This period may be shorter in duration when the heat load, is higher, the value dP/dT is greater and the heat transfer fluid is less dense and viscous. Start up and normal operation of the heat transfer apparatus according to the invention is guaranteed if the amount of the heat transfer fluid required for charging the apparatus is selected correctly.

Figure 2:
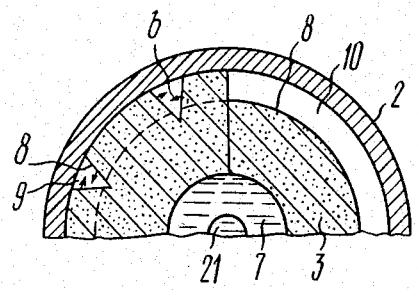
FIG. 2 is an enlarged partially sectional view of FIG. 1 taken along the line II—II.

When heat flux indicated by the arrows "a" in FIG. 1 is conveyed from the heat source to the vaporizer 3, the heat transfer fluid tends to evaporate from the surfaces 8 (FIG. 2) of the vapor release passages 9 and 10 (arrows "b") thereby absorbing the latent heat of vaporization. A flow of vapor thus formed (arrows "b" in FIG. 1) is conveyed along the vapor release passages 10 into the vapor header 11 to pass then through the inlet port 12 into the first pipe 13 and further into the space 16 of the condenser chamber 4 forcing the heat transfer fluid in a vapor phase into the end cavities 5, 6 of the evaporating chamber 1 and the axial passage 7 of the vaporizer. The vapor entering the annular space 16 of the condenser chamber 4 tends to condense on the surface of the shells 14 and 15 for the heat of condensation to be transferred by conduction through their walls to the heat sink, the heat flux travelling thereto being indicated by the arrows "d". The thus condensed heat transfer fluid forms a liquid "plug" blocking the inlet port 20 of the second pipe 21 and preventing the penetration of vapor bubbles into the pipe 21. When the apparatus is reoriented, i.e. when the evaporating chamber 1 assumes a position below the condenser chamber 4, the liquid plug rests in place by virtue of capillary forces acting in the narrowest point of the space 16 and partially by virtue of a dynamic head of the vapor flow. The liquid heat transfer fluid cooled in the condenser chamber 4 passes through the port 20 into the pipe 21 to flow therethrough and fill the end cavity 6, axial passage 7 and the end cavity 5. The heat transfer fluid is conveyed toward the evaporation surface 8 of the vapor release passages 9 and 10 (FIG. 2) basically in the radial direction from the longitudinal axial passage 7.

Thanks to the provision of the smooth annular projections 23 (FIG. 1) mating tightly with the inner side surface of the housing 2 of the evaporating chamber 1 and functioning as sealing elements, as well as due to the fact that the liquid heat transfer fluid remains in the capillary of the vaporizer 3 under the action of capillary forces, hot vapor fails to pass from the steam release passages 9 and 10 into the end cavities 5, 6 and the axial passage 7. A layer of capillary material of the vaporizer 3 separates the evaporation surface of the steam release passages 9 and 10 from the surface of the axial passage 7 and the end face surfaces of the vaporizer 3, this layer also possessing a certain amount of thermal resistance. Hot vapor with the parameters $T_1$ and $P_1$ is thereby formed in the steam release passages 9 and 10.

"Cold" vapor is formed in the region overlying the axial passage 7 and the end surfaces of the vaporizer 3, this could vapor having parameters $T_2$ and $P_2$ which are essentially less in value than the respective parameters $T_1$ and $P_1$.

An accompanying temperature difference $\Delta T_{1-2}=T_1-T_2$ dictates the occurence of the pressure difference $\Delta P_{1-2}=P_1-P_2$ which corresponds to the expression (5) and constitutes a motive force acting to drive the liquid heat transfer fluid from the pipe 13 and the space 16 of the condenser chamber 4 to fill the cavities 5 and 6 of the evaporating chamber 1 and the longitudinal axial passage 7 of the vaporizer 3 (FIG. 1). Therefore, when the heat transfer apparatus operates at an angle of inclination of $\phi=+90°$, two free vapor-liquid interfaces are formed therein. One such interface is formed at a certain level y-y (FIG. 1) in the upper end cavity 5, while the other one is formed at a level z-z in the space 16 of the condenser chamber 4. These levels are not stationary and their respective position is determined by a number of factors, such as the heat transfer load imparted and the intensity with which heat is removed from the condenser chamber 4. Assuming that the temperature and pressure of vapor in the region overlying the level y-y are $T_2$ and $P_2$, respectively and the temperature and pressure of vapor in the area overlying the level z-z are $T_3$ and $P_3$, then with allowance made for the losses $T_3<T_1$ and $P_3<P_1$ the conditions for a stable column of the liquid neat transfer fluid between the level y-y and z-z will be:

$$\Delta P_{3-2}=P_3-P_2=\Delta P_g+\Delta Pl_1 \quad (7),$$

where $\Delta Pl_1$ is the pressure losses of the liquid heat transfer fluid in the pipe 21 and space 16, in $N/m^2$.

Assuming further that the height of the liquid column approximates the length of the heat transfer apparatus, the value of $\Delta P_g$ can be determined by the expression (4).

In addition, in order that the apparatus according to the invention operate efficiency, it is also necessary to comply with the following conditions:

$$\Delta P_{1-2}=P_1-P_2=\Delta P_{3-2}+\Delta P_v \quad (8)$$

$$\Delta P_c \geqq \Delta P_{1-2}+\Delta Pl_2 \quad (9),$$

where $\Delta Pl_2$ is losses of the liquid heat transfer fluid in the vaporizer 3, in $N/m^2$.

However, since $\Delta P_l=\Delta Pl_1+\Delta Pl_2$, it follows that $\Delta P_c \geqq \Delta Pg+\Delta Pl+\Delta P_v$.

In consequence, as is seen from the latter expression, the efficiency of the proposed heat transfer apparatus is determined by the same condition (1) as that applied for conventional heat pipe constructions.

However, because pressure losses $\Delta Pl_1$ during the travel of the heat transfer fluid in a liquid phase along the smooth pipe 21 and the space 16 are relatively negligeable, it becomes possible to allow for losses in the pressure $\Delta Pl_2$ in the capillary of the vaporizer 3 by reducing their radii $r_c$ thereby increasing the capillary pressure head $\Delta P_c$ in accordance with the expression (2).

An increase in the capillary pressure head $\Delta P_c$ may be used to compensate for the hydrostatic resistance $\Delta Pg$ which occurs when the heat transfer apparatus is oriented within inclination angles $\phi>0°$.

An increase in the evaporation surface causing losses in the pressure $\Delta P_v$ of vapor, as well as losses of pressure $\Delta Pl_1$ in the liquid due to differentiation in the value of the space 16 enable to reduce the hydraulic resistance of the heat transfer apparatus and therefore to increase the efforts exerted by the capillary pressure head $\Delta P_c$ to overcome the hydrostatic resistance $\Delta Pg$.

The aforegoing enables to increase the heat flux capacity of the heat transfer apparatus even when it is orientated in the field of mass forces at an inclination angle of $\phi=+90°$ and transfer heat at considerable distances.

When the apparatus is orientated at inclination angles $\phi \leqq 0°$, it operates under more favourable conditions, such the hydrostatic pressure $\Delta Pg$ is either absent at $\phi=0°$ or enters the expression (1) with a negative value (−) to be added to the capillary pressure head $\Delta P_c$ at $\phi<0°$. A special elaboration of such conditions is irrelevant.

Figure 6:
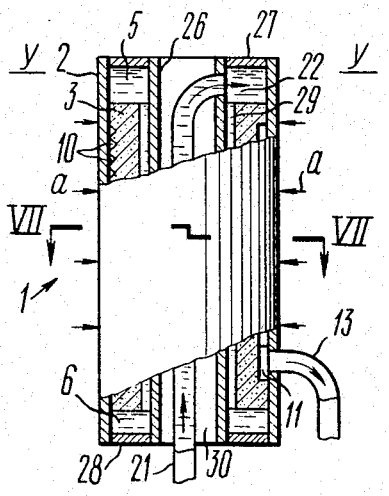
FIG. 6 is a partial section of a modified form of the vaporizer constructed according to the principles of this invention.
Figure 7:
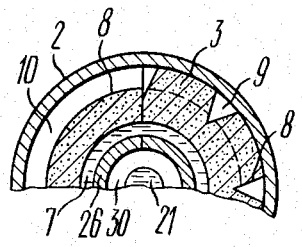
FIG. 7 is an enlarged partially sectional view taken along the line VII—VII of FIG. 6.

In view of the aforegoing, by increasing the capillary pressure head $\Delta P_c$ and redistributing pressure losses in the vapor and liquid heat transfer fluid through introducing structural modifications, it is possible to provide a highly efficient heat transfer apparatus the weight and overall dimensions of which along with structural simplicity thereof are comparable with conventional heat pipes, while the amount of heat flux transferred and the distance over which heat is transferred at orientation of the apparatus with inclinations angles close to or equalling $\phi+90°$ in the field of mass forces may be increased several fold. At a sufficiently large diameter of the evaporating chamber 1 thermal resistance of the heat transfer apparatus may be reduced in a modification illustrated in FIG. 6. The evaporation chamber 1 comprises a shell 26 (FIG. 7) secured on end face walls 27 and 28 (FIG. 6) of the evaporating chamber 1 and accommodated in the longitudinal axial passage 7 of the vaporizer 3 with a radial space 29 required to supply the heat transfer fluid toward the vaporizer 3 in a radial direction. The interior or passage 30 of the shell 26 is adapted to communicate with the outside.

The heat transfer apparatus according to the aforedescribed modified form of the evaporation chamber 1 operates in an essentially similar manner.

In a heat transfer apparatus embodying the present invention and having the length of 680 mm and a mass of 0.3 kg fabricated from stainless steel and nickel and employing acetone as a heat transfer fluid during orientation in a gravitational field at an inclination angle of $\phi=+90°$ a maximum heat flux capacity of 92 $kW/m^2$ at a vapor temperature of 341K has been attained in the vaporizer in a radial. direction. Therewith, the amount of heat flux transferred amounted to 0.204 kW·m. Extension of the apparatus to 1050 mm in overall length failed to result in a decrease in this value by more than 10%. Other conditions being equal, varying the orientation of the apparatus to inclination angles of $\phi=0°$ and $\phi=-90°$ resulted in an increase in the heat flux capacity by 10–25%.

What is claimed is:

1. A heat transfer apparatus comprising:
an evaporating chamber;
a side wall of said evaporating chamber;
two end face walls of said evaporating chamber;
a vaporizer of capillary material permeable to a heat transfer fluid and arranged coaxially inside said evaporating chamber to maintain a thermal contact with a heat source;
a first end cavity defined by one end surface of said vaporizer, said side wall and one of the two said end face walls of said evaporating chamber;
a second end cavity defined by another end surface of said vaporizer, said side wall and the other of the two said end face walls of said evaporating chamber;
a longitudinal axial passage arranged in said vaporizer and communicable with said first end cavity and said second end cavity;
smooth annular projection provided on the outer surface of said vaporizer adjacent ends thereof to prevent the heat transfer fluid in a vapor phase from flowing into said first and second end cavities;
a vapor header to collect the heat transfer fluid in a vapor phase arranged on the outer surface of said vaporizer;
vapor release passages provided on the outer surface of said vaporizer interposed between said smooth annular projections defined by longitudinal recesses and a plurality of annular recesses intersecting with the longitudinal recesses, said vapor release passages being communicable with said vapor header;
a condenser chamber;
a first shell defining an outer wall of said condenser chamber;
a second shell defining an inner wall of said condenser chamber, said second shell being secured inside said first shell coaxially therewith to form between the wall of said first shell and the wall of said second shell a space isolated from the outside, the cross-section of said space reducing in the direction of vapor travel path therealong;
a first pipe connecting said vapor header to a zone of said condenser chamber containing the heat transfer fluid in a vapor phase;
a second pipe connecting said evaporating chamber to a zone of said condenser chamber containing the heat transfer fluid in a liquid phase and passing inside said longitudinal axial passage;
an inlet port of said second pipe communicable with said space in an area thereof having the least cross-section;
an outlet port of said second pipe disposed inside said first end cavity of said evaporating chamber furtherst from said condenser chamber.

2. A heat transfer apparatus as defined in claim 1 wherein the longitudinal and annular recesses are triangular is section, apexes of the triangulars facing the longitudinal centerline of said vaporizer.

3. A heat transfer apparatus as defined in claim 1 wherein said inlet port of said second pipe is arranged at a location lengthwise of said condenser chamber furtherst from an outlet port of said first pipe.

4. A heat transfer apparatus as defined in claim 2 wherein said inlet port of said second pipe is arranged at a location lengthwise of said condenser chamber furtherst from an outlet port of said first pipe.

5. A heat transfer apparatus as defined in claim 1 wherein said first and second pipes have corrugated portions.

6. A heat transfer apparatus as defined in claim 1 wherein said first and second pipes have portions in the form of tubular spirals.

7. A heat transfer apparatus as defined in claim 1 comprising:
a third shell provided in said vaporizer secured to each of said two end face walls of said evaporating chamber and disposed in said longitudinal axial passage to form a radial space sufficient to convey the heat transfer fluid toward said vaporizer in a radial direction; an interior of said third shell being communicable with the outside.

8. A heat transfer apparatus as defined in claim 2 comprising:
a third shell provided in said vaporizer secured to each of said two end face walls of said evaporating chamber and disposed in said longitudinal axial passage to form a radial space sufficient to convey the heat transfer fluid towards said vaporizer in a radial direction; an interior of said third shell being communicable with the outside.

9. A heat transfer apparatus as defined in claim 4 comprising:
a third shell provided in said vaporizer secured to each of said two end face walls of said evaporating chamber and disposed in said longitudinal axial passage to form a radial space sufficient to convey the heat transfer fluid toward said vaporizer in a radial direction; an interior of said third shell being communicable with the outside.

10. A heat transfer apparatus as defined in claim 5 comprising:
a third shell provided in said vaporizer secured to each of said two end face walls of said evaporating chamber and disposed in said longitudinal axial passage to form a radial space sufficient to convey the heat transfer fluid toward said vaporizer in a radial direction; an interior of said third shell being communicable with the outside.

11. A heat transfer apparatus as defined in claim 6 comprising:
a third shell provided in said vaporizer secured to each of said two end face walls of said evaporating chamber and disposed in said longitudinal axial passage to form a radial space sufficient to convey the heat transfer fluid toward said vaporizer in a radial direction; an interior of said third shell being communicable with the outside.

* * * * *